US005431058A

United States Patent [19]

Lagier et al.

[11] Patent Number: 5,431,058

[45] Date of Patent: Jul. 11, 1995

[54] FLEXURAL STRAIN GAUGE ACOUSTIC TRANSDUCER FOR DEEP SUBMERSION

[75] Inventors: Michel Lagier, Le Canet; Philippe Dufourcq, Peymeinade, both of France

[73] Assignee: Thomson-CSF, Puteaux, France

[21] Appl. No.: 90,142

[22] PCT Filed: Jan. 14, 1992

[86] PCT No.: PCT/FR92/00025

§ 371 Date: Jul. 26, 1993

§ 102(e) Date: Jul. 26, 1993

[87] PCT Pub. No.: WO92/13338

PCT Pub. Date: Aug. 6, 1992

[30] Foreign Application Priority Data

Jan. 25, 1991 [FR] France ..... 91 00860

[51] Int. Cl.[6] ..... H04R 17/00

[52] U.S. Cl. ..... 73/774; 310/337; 367/167

[58] Field of Search ..... 73/774, 781, 785, 862.68; 310/328, 334, 336–338, 348; 367/167, 180, 137; 381/173

[56] References Cited

U.S. PATENT DOCUMENTS

| | | | |
|---|---|---|---|
| 4,420,826 | 12/1983 | Marshall, Jr. et al. . | |
| 4,524,693 | 6/1985 | McMahon et al. | 367/167 |
| 4,820,753 | 4/1989 | Caprette, Jr. et al. . | |
| 5,291,461 | 3/1994 | Boeglin et al. | 310/337 |

FOREIGN PATENT DOCUMENTS

| | | |
|---|---|---|
| 0340674 | 11/1989 | European Pat. Off. . |
| 0367681 | 5/1990 | European Pat. Off. . |

*Primary Examiner*—Robert Raevis

*Attorney, Agent, or Firm*—Oblon, Spivak, McClelland, Maier & Neustadt

[57] ABSTRACT

An acoustic transducer of the flexural strain gauge type, in which a shell body of oblong section is stressed by a motor along a major axis of this section. A viscoelastic element absorbs the slow deformation of the shell under the effect of submersion. The viscoelastic element exhibits a considerable stiffness at the frequencies of use of the transducer so as to transmit the vibrations from the motor to the shell with adequate efficiency. Such a device makes it possible to manufacture a flexural stain gauge transducer capable of withstanding considerable submersion without the motor fracturing and the efficiency of which is greater than 75%.

13 Claims, 2 Drawing Sheets

FLEXURAL STRAIN GAUGE ACOUSTIC TRANSDUCER FOR DEEP SUBMERSION

BACKGROUND OF THE INVENTION

1. Field of the Invention

The present invention relates to acoustic transducers of the flexural strain gauge type capable of being submerged to a considerable depth without suffering damage, while still operating correctly. It applies to the transmission and/or reception of sonic or ultrasonic acoustic waves in fluid media such as the underwater space.

2. Discussion of the Background

Known flexural strain gauge transducers are generally made up of a leaktight flexible shell with a cylindrical side wall of elliptical cross-section, set vibrating by one or more columns or bars of ceramic piezoelectric cells. Each column is held in compression between the furthest apart opposing parts of the side wall. In transmission, an alternating electric field is applied in the longitudinal direction of each column and the resulting motion, which takes place along the longitudinal axis of each column, is retransmitted and amplified to the surrounding liquid medium, the amplitude of this motion being maximal in the plane generated by the minor axes of the ellipses formed by each cross-section.

A compressive prestress of the piezoelectric cells of each column is necessary in order to prevent the breakage of the ceramic when the columns are stressed in tension.

This prestress is, according to a first known embodiment, supplied directly by the shell when the columns are assembled. The housings provided in the shell for the columns have, before assembly, lengths which are shorter than those of the columns. In order to set the columns in place, it suffices to apply two opposing external forces to the closest together facing parts of the side wall in order to compress the shell at this location and cause, through elastic deformation of the shell, a just sufficient increase in the length of the housings to allow installation of the columns. The prestress force is applied when the action of the two external forces is removed. The columns then remain compressed in their housings between the parts of the internal side wall of the shell in contact with their ends.

In order to obtain correct operation of the transducers at a specified depth, this embodiment necessitates imparting to the amplitude of the two external forces a value greater than that which is normally exerted by the hydrostatic pressure at this depth. This has the disadvantage of limiting the use of these types of transducers to depths for which the prestress force of the column can still be ensured, in order to prevent the breakage of the ceramic making up the piezoelectric cells.

According to a second known embodiment, the prestress force of each column can be obtained by means of a rod passing through each column following its longitudinal axis, the ends of the rod being bolted to the shell. However in this case, the hydrostatic pressure exerts, via the shell, a tensile load on each column which, when it is too large, causes failure of the ceramic making up the piezoelectric cells.

Finally, according to a third known embodiment, a description of which can be found in the U.S. Pat. No. 4 420 826, the stack of piezoelectric cells can be produced along a prestress rod which is not fixed by its ends to the shell. Retention of the stack is ensured by two rails so as not to be subjected, as in the embodiment described earlier, to a tensile load directed along the longitudinal axis of the column. However, here again, when the submersion of the transducer is such that one or two sides of the columns are no longer in contact with the shell, the transducer can no longer operate correctly.

The Applicant has also proposed, in French Patent Application No. 88 14416 filed on Apr. 11, 1988, two other embodiments of a flexural strain gauge transducer in which a counterweight is added to the ceramic columns, which may possibly be provided by a fluidic device. These devices operate correctly but these additional units complicate their manufacture.

SUMMARY OF THE INVENTION

In order to alleviate these disadvantages, the present invention proposes a flexural strain gauge acoustic transducer for deep submersion, including a hollow shell of oblong section and an electroacoustic motor intended to excite this shell along the major axis of this section, principally characterised in that it furthermore comprises viscoelastic means making it possible to absorb, without exhibiting appreciable mechanical resistance, the loads exerted by the shell on the motor under the effect of the deformations arising from the submersion, and exhibiting considerable stiffness at the operating frequencies of the motor in order to communicate the vibrations from this motor to the shell with adequate efficiency.

BRIEF DESCRIPTION OF THE DRAWINGS

Other features and advantages of the invention will emerge clearly in the following description given by way of non-limiting example with reference to the attached figures which represent.

DETAILED OF THE PREFERRED EMBODIMENTS

Figure 1:
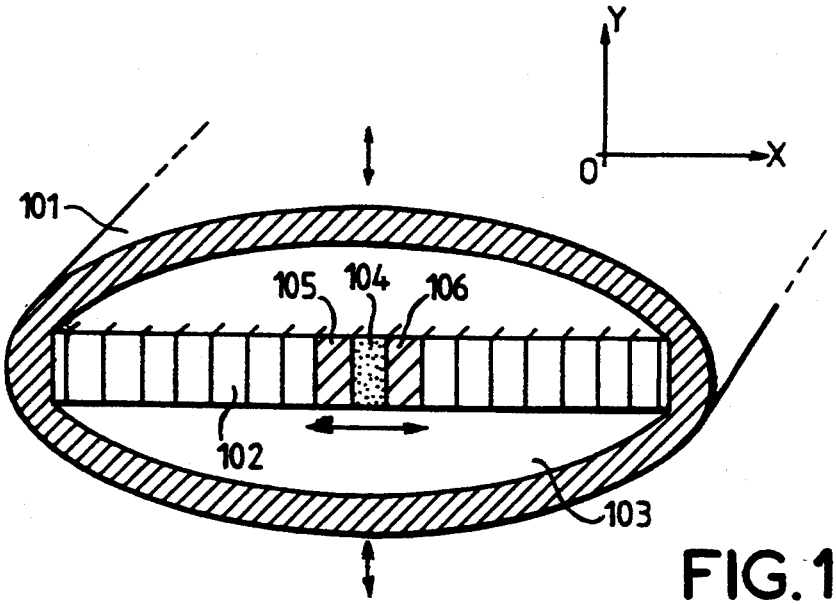
FIG. 1, a sectional view of a transducer according to a first embodiment of the invention.

In FIG. 1 has been represented a sectional view of a flexural strain gauge transducer of type 4 according to the classification compiled by ROYSTER in the journal JASA No. 38, 1965 p. 879 to 880.

This transducer comprises a shell of elliptical section 101 into which is inserted a piezoelectric motor 102 placed along the major axis of the ellipse and which bears via its two ends on the internal faces of the shell so as to make it vibrate, under the influence of an electric voltage, along an axis OX parallel to this major axis. Under this influence the shell starts to vibrate and the amplitude of the motion is maximal along an axis OY parallel to the minor axis of the ellipse.

When such a transducer is to operate in deep submersion, for example greater than 100 m, the shell deforms by flattening along an axis OY, and hence broadening along the axis OX since the inside 103 does not communicate with the outside and hence contains only air at atmospheric pressure. This broadening tends to pull on the motor 102, formed by a stack of piezoelectric ceramics. Since the latter do not withstand the tensile loads, there is a risk of them fracturing dynamically.

According to the invention, a piece 104, formed of a viscoelastic material whose static stiffness is low and dynamic stiffness is high, is inserted substantially at the center of the motor 102. In the example represented, in order to facilitate mechanical embodiment, two intermediate steel plates 105 and 106 have moreover been inserted between this viscoelastic piece and the ceramics making up the motor, but this arrangement is not essential. Likewise in the drawing the dimensions of the viscoelastic piece and of the metal plates are represented as substantially equal to those of the ceramic plates forming the motor, but the exact dimensioning will be chosen as a function of the characteristics of the materials used.

Thus, when the transducer is submerged, the shell 101 is squashed and the two parts, right and left, of the motor which are situated on either side of the piece 104 separate while exerting a tension on the latter. Since the static compliance (inverse of the stiffness) of the material used is large, the latter deforms progressively under the influence of the deformation of the shell and it stretches without exerting appreciable tension on the two parts of the motor. These latter are therefore not subjected to tensile loads liable to fracture them.

By contrast, when the motor is subjected to the alternating electrical voltages intended to generate the acoustic vibration, since the compliance of the viscoelastic material used is very low for the frequencies used, which correspond substantially to the resonant frequency of the transducer, this material behaves as if it were perfectly rigid. The bar formed by the two parts of the motor, the steel plates and the piece 104, thus vibrates as one whole, transmitting its vibrations to the shell of the transducer.

Since the material used exhibits a difference in compliance, or in stiffness, between the low frequencies which correspond to the static stresses and the high frequencies which correspond to the dynamic stresses, the behavior of the piece formed with this material can be summarised by saying that it behaves as a high-pass mechanical filter.

A transducer is characterised by:

$K_m$: stiffness of the piezoelectric motor $K_c$: stiffness of the shell

Q: quality factor $$\frac{fr}{B}$$

(resonant frequency over frequency band).

If $P_1$ is the limit pressure for which the motor is detached from the shell, that is, the motor will be detached from the shell when the pressure reaches a value for which the ceramics fracture and are thus from that moment no longer attached to the shell, and this pressure is defined as P1, $K_0$ the static stiffness of the seal and K its complex dynamic stiffness ($K=K'+jK''$), we have:

$$\tan\delta = \frac{G''}{G'} = \frac{K''}{K'}$$

G being the complex shear modulus ($G=G'+jG''$).

The constraints on the material of the seal are, for a hydrostatic pressure to be attained equal to $nP_1$:

$$K_0 = \frac{K_m K_c}{(n-1)(K_m + K_c)}$$

$$K > K_m \text{ and } fr \# \frac{1}{2}\left(\frac{K + K_c}{K_m + K_c}\right)^{\frac{1}{2}} f_0$$

where $f_0$ is the resonant frequency before the seals are set in place and n is a multiplying factor having a numerical value greater than 1.

We therefore obtain, where tg is the trigometric term tangent:

$$\frac{K}{tg\delta} > 3\,QK_m,$$

This latter condition makes it possible to obtain an efficiency i.e., a ratio of acoustic power delivered by the transducer versus electrical power applied thereto greater than 75%.

Various materials enable such a seal to be manufactured. A typical characteristic enabling these materials to be selected is that they have a glass transition at ambient temperature within the relevant frequency range.

Figure 2:
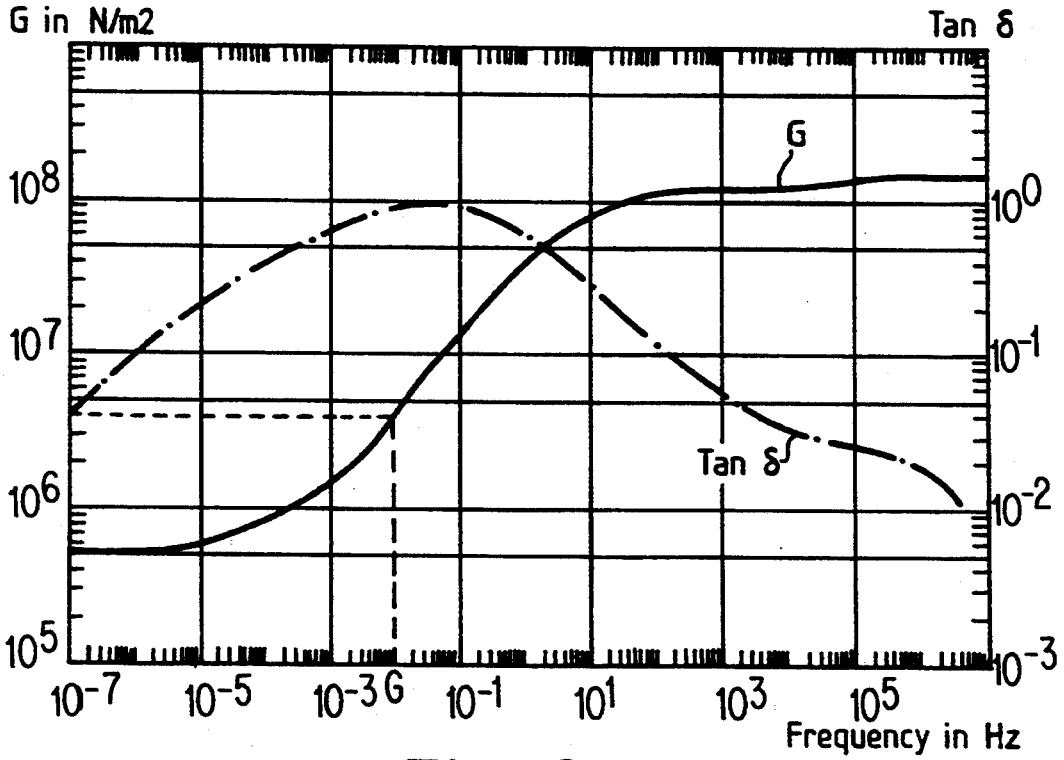
FIG. 2, a characteristic diagram of the material making up the piece 104 of FIG. 1.

By way of example, a polyurethane, whose stiffness modulus G expressed in $N/m^2$ and whose loss factor tan $\delta$ as a function of frequency in Hz have been represented in FIG. 2, can be used as material.

It is observed that the transition is obtained for a frequency substantially equal to $10^{-2}$ Hz, that is to say for very slowly changing stresses on the material (period 100 seconds corresponding typically to the progressive squashing of the shell of the flexural strain gauge when the latter is submerged deeper and deeper). The value $G_0$ of the modulus at this transition is then substantially equal to $4.10^6 N/m^2$.

Once a frequency of 1000 Hz is attained, significantly lower than the frequencies used in the flexural strain gauge, the modulus attains $1.5.10^8$ $N/m^2$ and tan $\delta$ equals $5.10^{-2}$. The dynamic range of the stiffnesses is then equal to 37.5 for this material, this making it possible to obtain entirely satisfactory results.

Figure 3:
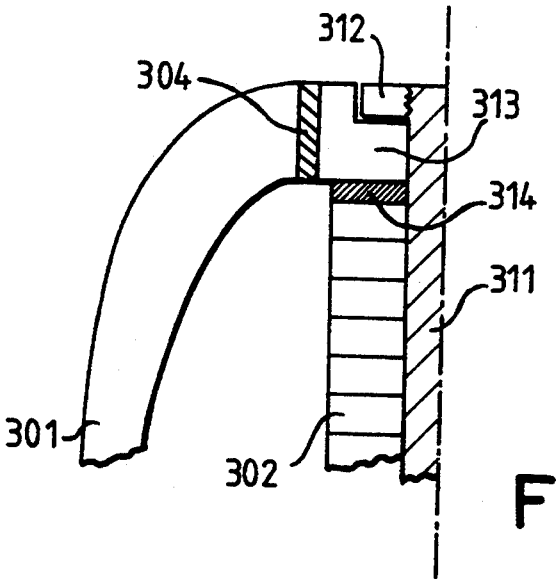
FIG. 3, a sectional view of a second embodiment.

The viscoelastic material may be placed in many other locations and a second embodiment has been represented in FIG. 3, in which a seal 304 is inserted between the shell 301 and the motor 302.

This motor 302 comprises a stack of ceramics subjected to a prestress with the aid of a rod 311 which passes right through the stack. Clamping nuts 312 screwed onto the ends of the rod so as to compress the ceramics via a metal bearing piece 313 and an insulating washer 314.

The viscoelastic seal 304 is formed of two plates inserted on either side between the shell and the piece 313. In this configuration, this seal 304 operates under flexion, while in the previous illustrative embodiment it operated under compression, but the result is the same.

Depending on the situation, the other end of the flexural strain gauge transducer of FIG. 3 can be identical to the end represented in FIG. 3, or else the motor can be fixed directly to the shell. The embodiment, including only one seal on one side only, is easier to manufacture but this seal is subjected to more considerable deformations, which are not always desirable.

In order to fix ideas and clearly demonstrate the orders of magnitude of the means of embodying the invention, a class 4 flexural strain gauge transducer will be considered, the depth of which is equal to 10 cm in length and the fixing of which is in accordance with FIG. 3 at the two ends of this motor. The shell therefore includes 4 flat seals 10 cm in length (2 on each side). The typical characteristics of such a transducer are for example:

$-P_1 = 30$ bars $-fr = 3$ kHz $-K_m = 10^9$ N/m $-Q = 4.2$ $-K_c = 2\ 10^8$ N/m With n=3 ( hence P limit=90 bar ), we obtain $K_0=8.3\ 10^7$ N/m.

The stiffness $K_0$ is equal to $$G_0 \cdot \frac{S}{e}$$

where $G_O$ is the static modulus, equal with the material described above to $4\ 10^6$ N/m$^2$ S and e being the total surface area and the thickness respectively of the seals.

A value of 25 cm$^2$, namely a height (along OX) equal to 2.5 cm, is obtained for the surface area of one seal (S/4). If the shell thickness is for example 15 mm, the transducer will be manufactured while thickening this shell at the level of the connection with the motor.

The dynamic stiffness then equals $$K = K_0 \cdot \frac{G}{G_O} = 3.1\ 10^9, \text{ so that } K = 3\ K_m.$$

The new resonant frequency obtained is therefore close to 2.5 kHz and is therefore well inside the usable region seen above.

For the condition related to the efficiency, that is to say $K/\tan\delta > 3\ QK_m$, we have $K/\tan\delta = 6.2.10^{10}$ while $3\ QK_m$ is equal to $1.26.10^{10}$. The efficiency is therefore markedly greater than 75%.

The invention extends equally to the other types of flexural strain gauges, such as those of class 2 or 5.

Figure 4A:
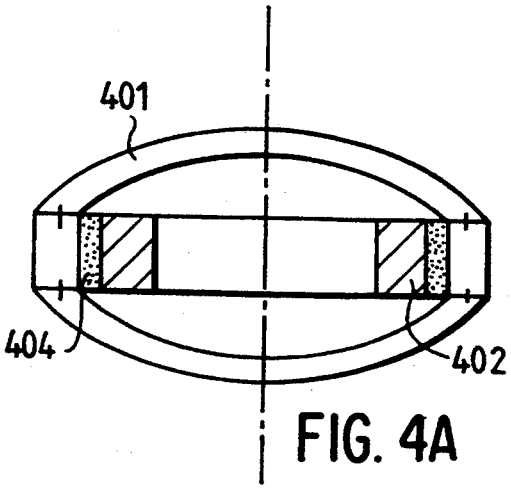
FIG. 4, sectional profile and plan views of a third embodiment.
Figure 4B:
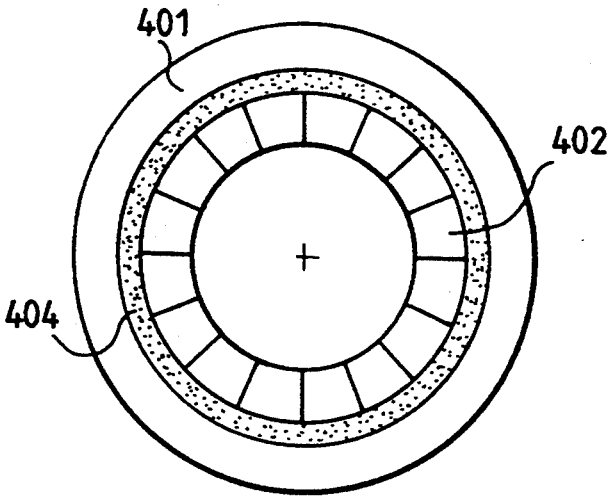

In this case, as represented in FIG. 4, the viscoelastic filter 404 has the shape of an annulus placed between the motor 402, itself annulus-shaped, and the shell 401 which takes the form of two domes assembled by their circumferences.

We claim:

1. A flexural strain gauge acoustic transducer for deep submersion, comprising:

a hollow shell having an oblong section and a major axis;

an electromagnetic motor for exciting the hollow shell along its major axis at predetermined operating frequencies;

a viscoelastic means contacting the electroacoustic motor for absorbing, without appreciable mechanical resistance, loads exerted by the hollow shell on the electroacoustic motor from deformations arising from submersion of the strain gauge, and for exhibiting considerable stiffness at the predetermined operating frequencies of the electroacoustic motor.

2. The flexural stain gauge acoustic transducer according to claim 1, wherein the electroacoustic motor comprises a plurality of piezoelectric elements, and the viscoelastic means is formed between two selected piezoelectric elements selected from the plurality of piezoelectric elements.

3. The flexural strain gauge acoustic transducer according to claim 2, further comprising two steel plates for connecting the viscoelastic means to respective of the two selected piezoelectric elements.

4. The flexural strain gauge acoustic transducer according to claim 2, wherein the viscoelastic means is formed at a center of the plurality of piezoelectric elements.

5. The flexural strain gauge acoustic transducer according to claim 1, wherein the viscoelastic means is formed of a material which exhibits a glass transition at an ambient temperature at a frequency which is lower than the predetermined operating frequencies of the electroacoustic motor.

6. The flexural strain gauge acoustic transducer according to claim 5, wherein the viscoelastic material comprises polyurethane exhibiting the glass transition at ambient temperature at a frequency substantially equal to $10^{-2}$ Hz.

7. The flexural stain gauge according to claim 1, wherein the electroacoustic motor is mounted to the hollow shell by a mounting means, and the viscoelastic means is formed between the hollow shell and the mounting means.

8. The flexural strain gauge according to claim 7, wherein the electroacoustic motor comprises a plurality of piezoelectric elements.

9. The flexural strain gauge acoustic transducer according to claim 7, wherein the viscoelastic means is formed of a material which exhibits a glass transition at an ambient temperature at a frequency which is lower than the predetermined operating frequencies of the electroacoustic motor.

10. The flexural strain gauge acoustic transducer according to claim 9, wherein the viscoelastic material comprises polyurethane exhibiting the glass transition at ambient temperature at a frequency substantially equal to $10^{-2}$ Hz.

11. The flexural strain gauge according to claim 1, wherein the electroacoustic motor comprises a plurality of piezoelectric elements formed in a circle, and the viscoelastic means forms an annulus situated between the hollow shell and the electroacoustic motor.

12. The flexural strain gauge acoustic transducer according to claim 11, wherein the viscoelastic means is formed of a material which exhibits a glass transition at an ambient temperature at a frequency which is lower than the predetermined operating frequencies of the electroacoustic motor.

13. The flexural strain gauge acoustic transducer according to claim 12, wherein the viscoelastic material comprises polyurethane exhibiting the glass transition at ambient temperature at a frequency substantially equal to $10^{-2}$ Hz.

* * * * *